US006761751B2

(12) United States Patent
Berglund et al.

(10) Patent No.: US 6,761,751 B2
(45) Date of Patent: Jul. 13, 2004

(54) METHOD OF MAKING A FECRAL MATERIAL AND SUCH MATERIAL

(75) Inventors: Roger Berglund, Västerås (SE); Bo Jönsson, Västerås (SE); Jonas Magnusson, Västerås (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 10/168,860

(22) PCT Filed: Dec. 18, 2000

(86) PCT No.: PCT/SE00/02571

§ 371 (c)(1),
(2), (4) Date: Oct. 16, 2002

(87) PCT Pub. No.: WO01/49441

PCT Pub. Date: Jul. 12, 2001

(65) Prior Publication Data

US 2003/0089198 A1 May 15, 2003

(30) Foreign Application Priority Data

Jan. 1, 2000 (SE) ..... 0000002

(51) Int. Cl.[7] ..... B22F 9/08; C22C 38/26

(52) U.S. Cl. ..... 75/338; 75/339; 148/325; 420/63

(58) Field of Search ..... 75/338, 339; 148/325; 420/62, 63

(56) References Cited

U.S. PATENT DOCUMENTS 4,226,644 A * 10/1980 Cox et al. ..... 75/246
4,540,546 A * 9/1985 Giessen ..... 420/590
5,620,651 A * 4/1997 Sikka et al. ..... 420/81
6,033,624 A * 3/2000 Gonsalves et al. ..... 419/48
6,302,939 B1 * 10/2001 Rabin et al. ..... 75/338
6,346,134 B1 * 2/2002 Russo et al. ..... 75/252
6,475,642 B1 * 11/2002 Zhao et al. ..... 428/636

FOREIGN PATENT DOCUMENTS

| | | | |
|---|---|---|---|
| DE | 42 35 141 A1 | | 6/1993 |
| DE | 195 11 089 A1 | | 9/1996 |
| EP | 0 658 633 A2 | | 6/1995 |
| JP | 63-227703 A | * | 9/1988 |
| JP | 6279811 A | | 10/1994 |
| JP | 8060210 A | | 3/1996 |

* cited by examiner

*Primary Examiner*—George Wyszomierski
(74) *Attorney, Agent, or Firm*—Alfred J. Mangels

(57) ABSTRACT

A method of producing an FeCrAl material by gas atomization, and a high temperature material produced by the method. In addition to containing iron (Fe), chromium (Cr), and aluminium (Al) the material also contains minor fractions of one or more of the materials molybdenum (Mo), hafnium (Hf), zirconium (Zr), yttrium (Y), nitrogen (N), carbon (C) and oxygen (O). The smelt to be atomized contains 0.05–0.50 percent by weight tantalum (Ta) and less than 0.10 percent by weight titanium (Ti). Nitrogen gas ($N_2$) is used as an atomizing gas, to which an amount of oxygen gas ($O_2$) is added, the amount of oxygen gas being such as to cause the atomized powder to contain 0.02–0.10 percent by weight oxygen (O) and 0.01–0.06 percent by weight nitrogen (N).

9 Claims, No Drawings

METHOD OF MAKING A FECRAL MATERIAL AND SUCH MATERIAL

BACKGROUND OF THE INVENTION

1. Field of the Invention

The present invention relates to a method of producing an FeCrAl material, and also to such material.

2. Description of the Related Art

Conventional iron-based alloys containing typically Fe and 12–25% Cr and 3–7% Al, so-called FeCrAl-alloys, have been found highly useful in various high temperature applications due to their good oxidation resistance. Thus, such materials have been used in the production of electrical resistance elements and as carrier materials in motor vehicle catalysts. As a result of its aluminum content, the alloy is able to form at high temperatures and in the majority of atmospheres an impervious and adhesive surface oxide consisting substantially of $Al_2O_3$. This oxide protects the metal against further oxidation and also against many other forms of corrosion, such as carburization, sulphuration, etc.

A pure FeCrAl alloy is characterized by a relatively low mechanical strength at elevated temperatures. Such alloys are relatively weak at high temperatures and tend to become brittle at low temperatures subsequent to having been subjected to elevated temperatures for a relatively long period of time, due to grain growth. One way of improving the high temperature strength of such alloys is to include non-metallic inclusions in the alloy and therewith obtain a precipitation hardening effect.

One known way of adding said inclusions is by a so-called mechanical alloying process in which the components are mixed in the solid phase. In this regard, a mixture of fine oxide powder, conventionally $Y_2O_3$, and metal powder having an FeCrAl composition is ground in high energy mills over a long period of time until an homogenous structure is obtained.

Grinding results in a powder that can later be consolidated, for instance by hot extrusion or hot isostatic pressing to form a completely tight product.

Although $Y_2O_3$ can be considered to be a highly stable oxide from a thermodynamic aspect, small particles of yttrium can be transformed or dissolved in a metal matrix under different circumstances.

It is known that in a mechanical alloy process yttrium particles react with aluminum and oxygen, therewith forming different kinds of Y—Al-oxides. The composition of these mixed oxide inclusions will change and their stability lowered during long-term use of the material, due to changes in the surrounding matrix.

It has also been reported that an addition of a strongly oxide-forming element in the form of titanium to a mechanically alloyed material that contains $Y_2O_3$ and 12% Cr can cause the separation of complex (Y+Ti) oxides, resulting in a material that has greater mechanical strength than a material that contains no titanium. The strength at elevated temperatures can be further improved, by adding molybdenum.

Thus, a material that has good strength properties can be obtained by means of a mechanical alloying process.

Mechanical alloying, however, is encumbered with several drawbacks. Mechanical alloying is carried out batchwise in high energy mills, in which the components are mixed to obtain an homogenous mixture. The batches are relatively limited in size, and the grinding process requires a relatively long period of time to complete. The grinding process is also energy demanding. The decisive drawback with mechanical alloying resides in the high product costs entailed.

A process in which an FeCrAl material alloyed with fine particles could be produced without needing to apply high energy grinding" would be highly beneficial from the aspect of cost.

It would be advantageous if the material could be produced by gas atomization, i.e., the production of a fine powder that is later compressed. This process is less expensive than when the powder is produced by grinding. Very small carbides and nitrides are precipitated in conjunction with the rapid solidification process, such carbides and nitrides being desirable.

However, the titanium constitutes a serious problem when atomizing an FeCrAl material. The problem is that small particles of mainly TiN and TiC are formed in the smelt prior to atomization. These particles tend to fasten on the refractory material. Since the smelt passes through a relatively fine ceramic nozzle prior to atomization, these particles will fasten to the nozzle and gradually accumulate. This causes clogging of the nozzle, therewith making it necessary to disrupt the atomization process. Such stoppages in production are expensive and troublesome. Consequently, FeCrAl materials that contain titanium are not produced by atomization in practice.

SUMMARY OF THE INVENTION

The present invention solves this problem and relates to a method in which an FeCrAl material can be produced by means of atomization.

The present invention thus relates to a method of producing an FeCrAl material by gas atomization, wherein said material in addition to iron (Fe), chromium (Cr) and aluminum (Al) also contains minor fractions of one or more of the materials molybdenum (Mo), hafnium (Hf), zirconium (Zr), yttrium (Y), nitrogen (N), carbon (C) and oxygen (O), and wherein the method is characterized by causing the smelt to be atomized to contain 0.05–0.50 percent by weight tantalum (Ta) and, at the same time, less than 0.10 percent by weight titanium (Ti).

The invention also relates to a high temperature material of a powder metallurgical FeCrAl alloy produced by gas atomization. In addition to containing iron (Fe), chromium (Cr) and aluminum (Al), the material also includes minor fractions of one or more of the materials molybdenum (Mo), hafnium (Hf), zirconium (Zr). yttrium (Y), nitrogen (N), carbon (C) and oxygen (O). The material also includes 0.05–0.50 percent by weight tantalum (Ta) and, at the same time, less than 0.10 percent by weight titanium (Ti).

DESCRIPTION OF THE PREFERRED EMBODIMENTS

The present invention relates to a method of producing an FeCrAl material by gas atomization. In addition to iron (Fe), chromium (Cr) and aluminum (Al), the FeCrAl material also includes minor fractions of one or more of the materials molybdenum (Mo), hafnium (Hf), zirconium (Zr), yttrium OO, nitrogen (N), carbon (C) and oxygen (O).

According to the present invention, the smelt to be atomized contains 0.05–0.50 percent by weight tantalum (Ta) and also less than 0.10 percent by weight titanium (Ti).

It has been found that tantalum imparts strength properties that are comparable with those obtained when using titanium, and at the same time TiC and TiN are not formed in quantities that cause clogging of the nozzle. This applies even when the smelt contains 0.10 percent by weight titanium.

Thus, it is possible to produce the material in question by gas atomization, by using tantalum instead of at least a part of the titanium quantity.

It is usual, and also possible, to use argon (Ar) as the atomizing gas. However, argon is adsorbed partly on accessible and available surfaces and partly in pores in the powder grains. In conjunction with subsequent heat consolidation and heat processing of the product, the argon will collect under high pressure in microdefects. These defects swell to form pores in later use at low pressure and high temperature, thereby impairing the strength of the product.

Powder that is atomized by means of nitrogen gas does not behave in the same manner as argon, since nitrogen has greater solubility in the metal than argon and since nitrogen is able to form nitrides. When gas atomizing with pure nitrogen gas, the aluminum will react with the gas and marked nitration of the surfaces of the powder grains can occur. This nitration makes it difficult to create bonds between the powder grains in conjunction with hot isostatic pressing (HIP), causing difficulties in the heat processing or the heat treatment of the resultant blank. In addition, individual powder grains may be so significantly nitrated as to cause the major part of the aluminum to bind as nitrides. Such particles are unable to form a protective oxide. Consequently, they can disturb the formation of oxide if they are present close to the surface of the end product.

It has been found that some oxidation of the powder surfaces is obtained when a controlled amount of gaseous oxygen is supplied to the nitrogen gas, while considerably reducing nitration at the same time. The risk of oxide disturbances is also greatly reduced.

Consequently, in accordance with one highly preferred embodiment, nitrogen gas ($N_2$) is used as an atomizing gas to which a given quantity of oxygen gas ($O_2$) is added, said amount of oxygen gas being such as to cause the atomized powder to contain 0.02–0.10 percent by weight oxygen (O) at the same time as the nitrogen content of the powder is 0.01–0.06 percent by weight.

According to one preferred embodiment, the smelt is caused to have a composition in which the powder obtained has the following composition in percent by weight, subsequent to atomization:

| | |
|---|---|
| Fe | balance |
| Cr | 5–25 percent by weight |
| Al | 3–7 |
| Mo | 0–5 |
| Y | 0.05–0.60 |
| Zr | 0.01–0.30 |
| Hf | 0.05–0.50 |
| Ta | 0.05–0.50 |
| Ti | 0–0.10 |
| C | 0.01–0.05 |
| N | 0.01–0.06 |
| O | 0.02–0.10 |
| Si | 0.10–0.70 |
| Mn | 0.05–0.50 |
| P | 0–0.08 |
| S | 0–0.005 |

According to one particularly preferred embodiment, the smelt is caused to have a composition such that subsequent to atomization the resultant powder will have roughly the following composition in percent by weight:

| | |
|---|---|
| Fe | balance |
| Cr | 21 percent by weight |
| Al | 4.7 |
| Mo | 3 |
| Y | 0.2 |
| Zr | 0.1 |
| Hf | 0.2 |
| Ta | 0.2 |
| Ti | <0.05 |
| C | 0.03 |
| N | 0.04 |
| O | 0.06 |
| Si | 0.4 |
| Mn | 0.15 |
| P | <0.02 |
| S | <0.001 |

Subsequent to heat treatment, the creep strength or creep resistance of the material is influenced to a great extent by the presence of oxides of yttrium and tantalum and by carbides of hafnium and zirconium.

According to one preferred embodiment, the value of the formula $((3\times Y+Ta)\times O)+((2\times Zr+Hf)\times(N+C))$, where the identification of the elements in the formula represents, the content in weight percent of the respective elements in the smelt, is greater than 0.04 but smaller than 0.35.

Although the invention has been described above with reference to a number of exemplifying embodiments, it will be understood that the composition of the material can be modified to some extent while still obtaining a satisfactory, material.

The present invention is therefore not restricted to said embodiments, since variations can be made within the scope of the accompanying claims.

What is claimed is:

1. A method of producing an FeCrAl material by gas atomization, said method comprising the steps of: adding to iron (Fe), chromium (Cr) and aluminum (Al) minor fractions of materials selected from the group consisting of molybdenum (Mo), hafnium (Hf), zirconium (Zr), yttrium (Y), nitrogen (N), carbon (C) and oxygen (O), and combinations and mixtures thereof, adding to a smelt to be atomized 0.05–0.50 percent by weight tantalum (Ta) and less than 0.10 percent by weight titanium (Ti), and gas atomizing the smelt.

2. A method according to claim 1, including the step of utilizing nitrogen gas ($N_2$) as an atomizing gas and adding a given amount of oxygen gas ($O_2$) to the atomizing gas, wherein said amount of oxygen gas is such that the atomized powder contains 0.02–0.10 percent by weight oxygen (O) and 0.01–0.06 percent by weight nitrogen (N).

3. A method according to claim 1, wherein the powder obtained after atomization has the following composition in percent by weight:

| | |
|---|---|
| F | balance |
| Cr | 15–25 |
| Al | 3–7 |
| Mo | 0–5 |
| Y | 0.05–0.60 |
| Zr | 0.01–0.30 |
| Hf | 0.05–0.50 |
| Ta | 0.05–0.50 |
| Ti | 0–0.10 |

-continued

| | |
|---|---|
| C | 0.01–0.05 |
| N | 0.01–0.06 |
| O | 0.02–0.10 |
| Si | 0.10–0.70 |
| Mn | 0.05–0.50 |
| P | 0–0.08 |
| S | 0–0.005. |

4. A method according to claim 3, wherein the smelt has a composition such that the powder obtained after atomization has substantially the following composition in percent by weight:

| | |
|---|---|
| Fe | balance |
| Cr | 21 |
| Al | 4.7 |
| Mo | 3 |
| Y | 0.2 |
| Zr | 0.1 |
| Hf | 0.2 |
| Ta | 0.2 |
| Ti | <0.05 |
| C | 0.03 |
| N | 0.04 |
| O | 0.06 |
| Si | 0.4 |
| Mn | 0.15 |
| P | <0.02 |
| S | <0.001. |

5. A method according to claim 1, wherein the value of the formula ((3×Y+Ta)×O)+((2×Zr+Hf)×(N+C)), in which the elements are given in percent by weight in the smelt, is greater than 0.04 and less than 0.35.

6. High temperature material of a powder metallurgical FeCrAl alloy produced by gas atomization, said material comprising: iron (Fe), chromium (Cr) and aluminum (Al) and minor fractions of materials selected from the group consisting of molybdenum (Mo), hafnium (Hf), zirconium (Zr), yttrium (Y), nitrogen (N), carbon (C) and oxygen (O), and combinations and mixtures thereof, and wherein the material includes 0.05–0.50 percent by weight tantalum (Ta) and less than 0.10 percent by weight titanium (Ti), said tantalum and titanium present in amounts such that titanium compounds, are not formed in quantities that cause clogging of a gas atomization nozzle.

7. High temperature material according to claim 6, wherein the powder obtained by gas atomization has the following composition in percent by weight:

| | |
|---|---|
| Fe | balance |
| Cr | 15–25 |
| Al | 3–7 |
| Mo | 0–5 |
| Y | 0.05–0.60 |
| Zr | 0.01–0.30 |
| Hf | 0.05–0.50 |
| Ta | 0.05–0.50 |
| Ti | 0–0.10 |
| C | 0.01–0.05 |
| N | 0.01–0.06 |
| O | 0.02–0.10 |
| Si | 0.10–0.70 |
| Mn | 0.05–0.50 |
| P | 0–0.08 |
| S | <0.005. |

8. High temperature material according to claim 7, wherein the powder obtained has substantially the following composition in percent by weight:

| | |
|---|---|
| Fe | balance |
| Cr | 21 |
| Al | 4.7 |
| Mo | 3 |
| Y | 0.2 |
| Zr | 0.1 |
| Hf | 0.2 |
| Ta | 0.2 |
| Ti | <0.05 |
| C | 0.03 |
| N | 0.04 |
| O | 0.06 |
| Si | 0.4 |
| Mn | 0.15 |
| P | <0.02 |
| S | <0.001. |

9. High temperature material according to claim 6, wherein the value of the formula ((3×Y+Ta)×O)+((2×Zr+Hf)×(N+C)), in which the elements are given in percent by weight of a smelt, exceeds 0.04 but is less than 0.35.

* * * * *